US009575453B1

(12) United States Patent
Boyatt, III et al.

(10) Patent No.: US 9,575,453 B1
(45) Date of Patent: Feb. 21, 2017

(54) SYSTEM AND METHOD FOR CONTROLLING MEDIA BUBBLE FORMATION IN AN IMAGING DEVICE

(71) Applicant: LEXMARK INTERNATIONAL, INC., Lexington, KY (US)

(72) Inventors: Richard Gordon Boyatt, III, Lexington, KY (US); Jichang Cao, Lexington, KY (US); William Paul Cook, Lexington, KY (US); Edward Lawrence Kiely, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/071,335

(22) Filed: Mar. 16, 2016

(51) Int. Cl.
*G03G 15/20* (2006.01)
*G03G 15/00* (2006.01)

(52) U.S. Cl.
CPC ..... *G03G 15/6576* (2013.01); *G03G 15/2064* (2013.01); *G03G 15/2085* (2013.01)

(58) Field of Classification Search
CPC ..... G03G 15/6576; G03G 15/2064; G03G 15/2085
USPC ..... 399/68
See application file for complete search history.

(56) References Cited

U.S. PATENT DOCUMENTS

2005/0152710 A1* 7/2005 Camp ..... G03G 15/657 399/68
2012/0087687 A1* 4/2012 Moteki ..... G03G 15/657 399/68

* cited by examiner

*Primary Examiner* — Hoang Ngo
(74) *Attorney, Agent, or Firm* — John Victor Pezdek

(57) ABSTRACT

A media path assembly in an imaging device includes a media guide positioned adjacent and transverse to a media path between a first and a second nip, and having a surface forming a bubble chamber across the media path. A bubble sensor and a narrow media sensor are positioned adjacent to the bubble chamber transverse to the media path and aligned with each other. The bubble sensor is operative to indicate formation in the bubble chamber of a bubble in a media sheet exiting the first nip. The narrow media sensor is operative to indicate media size of the media sheet and, when the media sheet is wide media, provide a balancing force to the media sheet relative to a force applied by the bubble sensor to the media sheet so that a leading edge of the media sheet substantially aligns with the second nip when entering the second nip.

25 Claims, 11 Drawing Sheets

SYSTEM AND METHOD FOR CONTROLLING MEDIA BUBBLE FORMATION IN AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Disclosure

The present disclosure relates generally to a media path assembly in an imaging device, and, more particularly, to a system and method for controlling media bubble formation in the imaging device.

Description of the Related Art

Imaging devices, such as an electrophotographic printer, typically monitor and control the movement of media sheets at various points along the media path to ensure adequate print quality. Example areas where media sheet movement is carefully monitored and controlled are the toner transfer nip and the fusing nip. The toner transfer nip and fusing nip each function to move the media sheet along a media path section in addition to their respective toner transfer and fusing functions. If the media sheet moves too quickly or slowly through the toner transfer nip, toner images may not be adequately transferred to the media sheet which may result in print defects. The speed of the media sheet through the fusing nip may also be controlled to optimally fix toner to the media sheet.

The media sheet may move at different speeds along different sections of the media path. For example, the media sheet may move at a different speed through the fuser nip than it moves through the toner transfer nip. In some existing imaging devices, the distance between the toner transfer nip and fusing nip is less than the length of a typical media sheet such that the media sheet may be present in both the transfer nip and the fuser nip at the same time. In this case, if the fuser nip is driven faster than the toner transfer nip, the fuser nip may drag the media sheet and cause print defects. On the other hand, if the fuser nip is driven slower than the toner transfer nip, a bubble will form in the media sheet. The size of the bubble generally depends on the relative speeds between the two nips. If the bubble size is too large, the media sheet may contact elements outside of the media path, which may disturb the toner image on the media sheet, deposit unwanted toner on the media sheet, or otherwise adversely affect print quality. On the other hand, having a bubble size that is too shallow introduces the risk of dragging the media sheet caused by variation in the speed through the fusing nip. Thus, controlling the bubble size is important to maintain image quality. Prior art imaging devices incorporate a bubble sensor between the toner transfer nip and fusing nip in order to sense and control bubble growth on media sheets being fed between the two nips.

In an imaging device employing a reference-edge media feed system in which a side edge of a media sheet rides along a reference edge of the imaging device during feeding, the bubble sensor is typically positioned near the reference edge to allow bubble detection on a wide range of media sizes, including the narrowest media supported. During feeding, the bubble sensor touches the media sheet and applies a drag force on the media sheet. When narrow media is fed, the drag force applied on the media sheet is relatively close to its centerline allowing the media sheet to be fed into the fusing nip without skew or an objectionable amount thereof. However, when wider media is fed, feed reliability may be comprised. This is because the drag force applied by the bubble sensor is positioned farther from the centerline of the wide media which creates a moment on the media sheet that skews the media sheet which may result in poor entry into the fusing nip. Poor entry into the fusing nip may cause print defects. It would be advantageous to be able to reduce, if not eliminate, the imbalance applied on wide media sheets during feeding while maintaining the control of bubble formation.

SUMMARY

In one example embodiment, a media path assembly in an imaging device includes a media guide positioned adjacent and transverse to a media path between a first nip and a second nip of the imaging device. In one form, the first nip is a toner transfer nip and the second nip is a fuser nip. The media guide directs a leading edge of a media sheet exiting the first nip into the second nip in a media process direction, and has a curved surface forming a bubble chamber across the media path. A first flag assembly and a second flag assembly are positioned adjacent to the media guide and the bubble chamber transverse to the media path and aligned with each other. A position of the second flag assembly corresponds to a location in the media guide at which a media sheet of a first media size contacts the second flag assembly when the media sheet of the first media size passes through the media path and at which the second flag assembly is not contacted by a media sheet of a second media size that is less than the first media size when the media sheet of the second media size passes through the media path. A position of the first flag assembly corresponds to a location in the media guide at which the media sheet of the first media size and the media sheet of the second media size contact the first flag assembly when passing through the media path. The first flag assembly comprises a bubble sensor that is operative to indicate formation in the bubble chamber of a bubble in the media sheet exiting the first nip. When the media sheet exiting the first nip is of the first media size, the second flag assembly applies a balancing force thereto relative to a force applied by the first flag assembly to the media sheet exiting the first nip so that the leading edge thereof when entering the second nip is substantially aligned with the second nip. In one form, the second flag assembly comprises a media size sensor that is operative to indicate whether the media sheet exiting the first nip has a media size corresponding to one of the first media size and the second media size.

In another example embodiment, a method for controlling bubble formation in the media sheet exiting the toner transfer nip in the media process direction includes advancing the media sheet exiting the toner transfer nip along the media path from the toner transfer nip to the fusing nip of a fuser at a media process speed. During the advancing of the media sheet exiting the toner transfer nip, it is determined whether or not the media sheet exiting the toner transfer nip has a media size corresponding to one of the first media size and the second media size based on a detection of a change in an output of the second media sensor as the media sheet exiting the toner transfer nip moves along the media guide. The method further includes controlling the fuser to operate at a first speed when the media size determined is the first media size, and at a second speed slower than the first speed when the media size determined is the second media size, the first and second speeds being slower than the media process speed at the toner transfer nip to allow for formation of a bubble in the media sheet exiting the toner transfer nip as the media sheet simultaneously traverses the toner transfer nip and the fusing nip. A depth of the bubble in the media sheet exiting the toner transfer nip is determined based on an output of the first media sensor. When the determined depth of the bubble in the media sheet exiting the toner transfer nip exceeds a first predetermined bubble depth, the fuser is controlled to operate at a third speed greater than at least one of the first and second speeds to reduce the depth of the bubble towards a second predetermined bubble depth that is less than the first predetermined bubble depth.

In another example embodiment, an imaging apparatus includes a transfer roll and a backup roll forming a toner transfer nip therebetween, and a fuser having a fusing nip positioned downstream of the toner transfer nip in a media process direction. A media guide, having a curved surface forming a bubble chamber, is positioned adjacent and transverse to a media path portion between the toner transfer nip and the fusing nip for directing a leading edge of a media sheet exiting the toner transfer nip into the fusing nip. A reference edge is positioned parallel to the media path portion. A first media sensor and a second media sensor are positioned adjacent the media guide transverse to the media path portion and aligned with each other. The first media sensor is positioned adjacent the bubble chamber and transversely positioned at a first distance from the reference edge and the second media sensor is transversely positioned at a second distance greater than the first distance from the reference edge such that a media sheet of a first media size contacts both the first and second media sensors when passing through the media path portion, and a media sheet of a second media size less than the first media size contacts the first media sensor and does not contact the second media sensor when passing through the media path portion. The first media sensor is operative to indicate a depth of a bubble formed in the media sheet exiting the toner transfer nip and the second media sensor is operative to indicate whether the media sheet exiting the toner transfer nip has a media size corresponding to one of the first media size and the second media size. The second media sensor is positioned at the second distance such that when the media sheet exiting the toner transfer nip has the first media size, the second media sensor applies a balancing force thereto relative to a force applied by the first media sensor to the media sheet exiting the toner transfer nip so that the leading edge of the media sheet exiting the toner transfer nip when entering the fusing nip is substantially aligned with the fusing nip.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
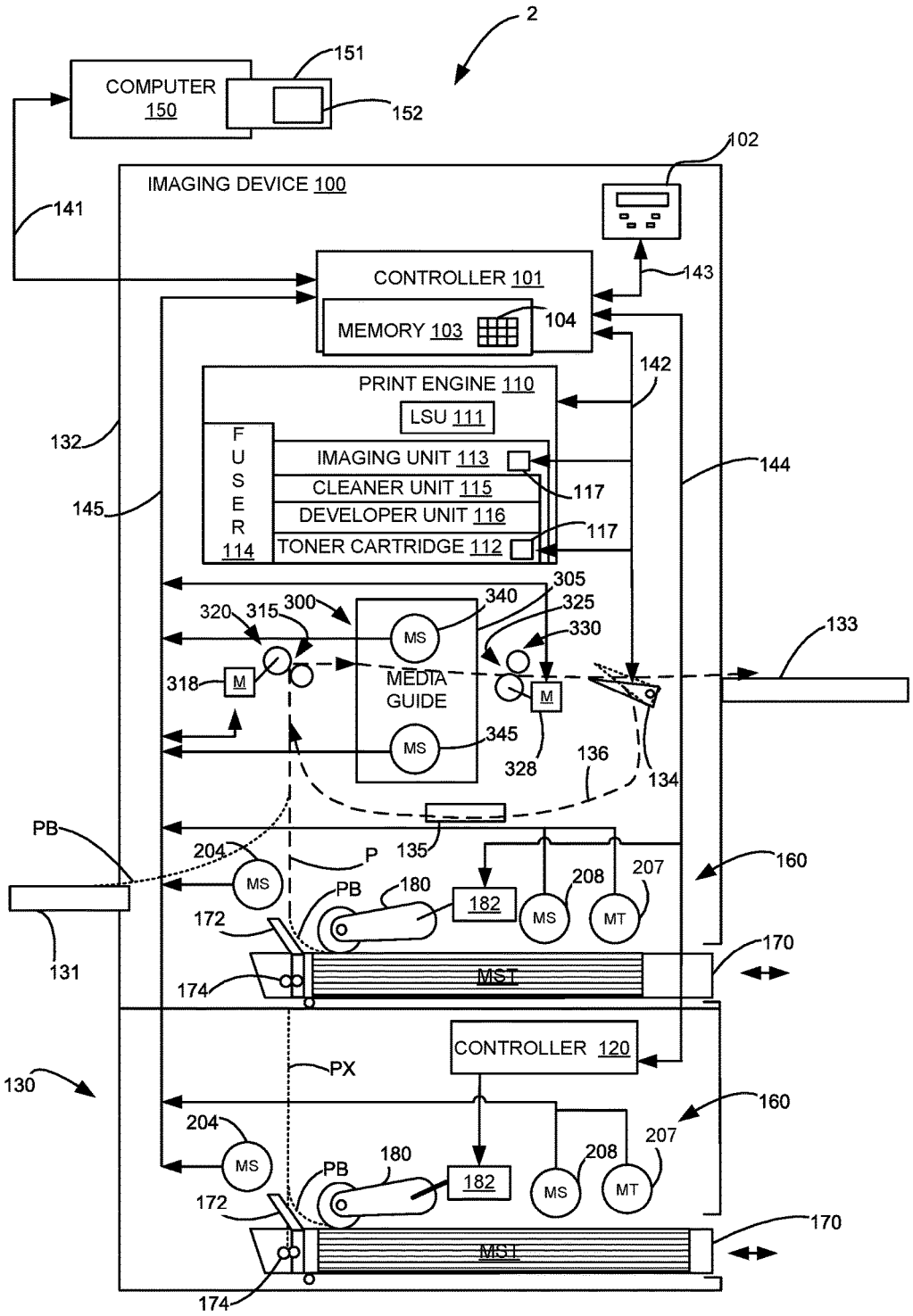
FIG. 1 is a schematic illustration of an imaging system according to one example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open-ended terms that indicate the presence of stated elements or features, but do not preclude additional elements or features. The articles "a", "an", and "the" are intended to include the plural as well as the singular, unless the context clearly indicates otherwise. The terms "including," "comprising," or "having" and variations thereof used herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

In addition, it should be understood that embodiments of the present disclosure may include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to present example embodiments of the present disclosure and that other alternative mechanical configurations are possible.

It will be further understood that the methods described may be implemented by computer program instructions. These computer program instructions may be loaded onto a general purpose computer, special purpose computer, processor, or other programmable data processing apparatus such that the instructions which execute on the computer or other programmable data processing apparatus may create means for implementing the functionality of each action in the methods discussed in detail in the descriptions below. These computer program instructions may also be stored in a non-transitory, tangible, computer readable storage medium that may direct a computer or other programmable data processing apparatus to function in a particular manner, such that the instructions stored in the computer readable storage medium may produce an article of manufacture including an instruction means that implements the functions specified in the methods. Computer readable storage medium includes, for example, disks, CD-ROMS, Flash ROMS, nonvolatile ROM and RAM. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions of the described methods. Results of the computer program instructions may be used by other computer programs or may be displayed in a user interface or computer display of the computer or other programmable apparatus that implements the functions or the computer program instructions.

The term "output" as used herein encompasses output from any printing device such as color and black-and-white copiers, color and black-and-white printers, and multifunction devices that incorporate multiple functions such as scanning, copying, and printing capabilities in one device. Such printing devices may utilize ink jet, dot matrix, dye sublimation, laser, and any other suitable print formats. The term "button" as used herein means any component, whether a physical component or graphic user interface icon, that is engaged to initiate an action or event.

The term "image" as used herein encompasses any printed or electronic form of text, graphics, or a combination thereof. "Media" or "media sheet" refers to a material that receives a printed image or, with a document to be scanned, a material containing a printed image. The media is said to move along the media path and any media path extensions from an upstream location to a downstream location as it moves from the media trays or media input areas to the output area of the imaging device. For a top feed option tray, the top of the option tray is downstream from the bottom of the option tray. Conversely, for a bottom feed option tray the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the media path. The term "media length" refers to the dimension of the media that is aligned with the media path. "Media process direction" describes the movement of media within the imaging system and is generally meant to be from an upstream location such as an input tray toward a downstream location such as an output of the imaging system. For a duplex path, the media process direction is generally from a position downstream of the print engine to a position upstream of the print engine. Further relative positional terms may be used herein. For example, "superior" means that an element is above another element. Conversely "inferior" means that an element is below or beneath another element.

Media is conveyed using pairs of aligned rolls forming feed nips. The term "nip" is used in the conventional sense to refer to the opening formed between two rolls that are located at about the same point in the media path. The rolls forming the nip may be separated apart, be tangent to each other, or form an interference fit with one another. With this nip type, the axes of the rolls are parallel to one another and are typically, but do not have to be, transverse to the media path. For example, a deskewing nip may be at an acute angle to the media feed path. The term "separated nip" refers to a nip formed between two rolls that are located at different points along the media path and have no common point of tangency with the media path. Again the axes of rotation of the rolls having a separated nip are parallel but are offset from one another along the media path. Nip gap refers to the space between two rolls. Nip gaps may be positive, where there is an opening between the two rolls, zero where the two rolls are tangentially touching or negative where there is an interference fit between the two rolls.

As used herein, the term "communication link" is used to generally refer to a structure that facilitates electronic communication between multiple components. While several communication links are shown, it is understood that a single communication link may serve the same functions as the multiple communication links that are illustrated. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. Devices interconnected by a communication link may use a standard communication protocol, such as for example, universal serial bus (USB), Ethernet or IEEE 802.xx, or other communication protocols.

Referring now to the drawings and particularly to FIG. 1, there is shown a diagrammatic depiction of an imaging system 2. As shown, imaging system 2 may include an imaging device 100, and an optional computer 150 attached to the imaging device 100. Imaging system 2 may be, for example, a customer imaging system, or alternatively, a development tool used in imaging apparatus design. Imaging device 100 is shown as a printer that includes a controller 101, a print engine 110, a user interface 102, and/or one or more option assemblies 130. Imaging device 100 may also be configured to include a scanner system and various finishing options such as a stapler, and hole punch.

Controller 101 includes a processor unit and associated memory 103, and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 101. Memory 103 may contain computer programs and look-up tables 104 to be used in controlling operation of imaging device 100 or one or more of its subsystems.

In FIG. 1, controller 101 is illustrated as being communicatively coupled with computer 150 via communication link 141. Controller 101 is illustrated as being communicatively coupled with print engine 110 and user interface 102 via communication links 142, 143, respectively. Computer 150 includes in its memory 151 a software program including program instructions that function as an imaging driver 152, e.g., printer/scanner driver software, for imaging device 100. Imaging driver 152 is in communication with controller 101 of imaging device 100 via communication link 141. Imaging driver 152 facilitates communication between imaging device 100 and computer 150. One aspect of imaging driver 152 may be, for example, to provide formatted print data to imaging device 100, and more particularly to print engine 110, to print an image. Another aspect of imaging driver 152 may be, for example, to facilitate collection of scanned data from a scanner system.

In some circumstances, it may be desirable to operate imaging device 100 in a standalone mode. In the standalone mode, imaging device 100 is capable of functioning without computer 150. Accordingly, all or a portion of imaging driver 152, or a similar driver, may be located in controller 101 of imaging device 100 so as to accommodate printing and/or scanning functionality when operating in the standalone mode.

Print engine 110 and user interface 102 may include firmware maintained in memory 103 which may be performed by controller 101 or another processing element. Controller 101 may be, for example, a combined printer, scanner and finisher controller. Controller 101 serves to process print data and to operate print engine 110 and its subassemblies such as a laser scan unit (LSU) 111, a toner cartridge 112, an imaging unit 113, a fuser 114, a cleaner unit 115 and a developer unit 116, during printing. Controller 101 may provide to computer 150 and/or to user interface 102 status indications and messages regarding the media supply media transport, imaging device 100 itself or any of its subsystems, consumables status, etc. Computer 150 may provide operating commands to imaging device 100. Computer 150 may be located nearby imaging device 100 or be remotely connected to imaging device 100 via an internal or external computer network. Imaging device 100 may also be communicatively coupled to other imaging devices.

Print engine 110 is illustrated as including LSU 111, toner cartridge 112, imaging to unit 113, and fuser 114, all mounted within imaging device 100. Imaging unit 113 may be removably mounted within imaging device 100 and includes developer unit 116 that houses a toner sump and a toner delivery system. The toner delivery system includes a toner adder roll that provides toner from the toner sump to a developer roll. A doctor blade provides a metered uniform layer of toner on the surface of the developer roll. Imaging unit 113 also includes cleaner unit 115 that houses a photoconductive drum and a waste toner removal system. Toner cartridge 112 is also removably mounted in imaging device 100 in a mating relationship with developer unit 116 of imaging unit 113. An exit port on toner cartridge 112 communicates with an entrance port on developer unit 116 allowing toner to be periodically transferred from toner cartridge 112 to resupply the toner sump in developer unit 116. Both imaging unit 113 and toner cartridge 112 may be replaceable items for imaging device 100. Imaging unit 113 and toner cartridge 112 may each have a memory device 117 mounted thereon for providing component authentication and information such as type of unit, capacity, toner type, toner loading, pages printed, etc. Memory device 117 is illustrated as being operatively coupled to controller 101 via communication link 142.

The electrophotographic imaging process is well known in the art and, therefore, will be only briefly described. During an imaging operation, LSU 111 creates a latent image by discharging portions of the charged surface of the photoconductive drum in cleaner unit 115. Toner is transferred from the toner sump in developer unit 116 to the latent image on the photoconductive drum by the developer roll to create a toned image. The toned image is then transferred either directly to a media sheet received in imaging unit 113 from one of media input trays 170 or to an intermediate transfer member (ITM) 118 (see FIG. 2) and then to a media sheet. Next, the toned image is fused to the media sheet in fuser 114 and then sent to an output location 133 or a duplexer 135. One or more gates 134, illustrated as being in operable communication with controller 101 via communication link 142, are used to direct the media sheet to output location 133 or duplexer 135. Toner remnants are removed from the photoconductive drum by the waste toner removal system housed within cleaner unit 115. As toner is depleted from developer unit 116, toner is transferred from toner cartridge 112 into developer unit 116. Controller 101 provides for the coordination of these activities including media movement occurring during the imaging process.

Controller 101 also communicates with a controller 120 in each option assembly 130 provided, via communication link 144. Controller 120 operates various motors housed within option assembly 130 that position media for feeding, feed media from media path branches PB into media path P or media path extensions PX as well as feed media along media path extensions PX. Controllers 101, 120 control the feeding of media along media path P and control the travel of media along media path P and media path extensions PX.

Imaging device 100 and option assembly 130 each also include a media feed system 160 having a removable media input tray 170 for holding a media stack MST, and a pick mechanism 180 with a drive mechanism 182 positioned adjacent each removable media input tray 170. Each media tray 170 also has a media dam assembly 172 and a feed roll assembly 174. In imaging device 100, pick mechanism 180 is mechanically coupled to drive mechanism 182 that is controlled by controller 101 via communication link 144. In option assembly 130, pick mechanism 180 is mechanically coupled to drive mechanism 182 that is controlled by controller 101 via controller 120 and communication link 144. In both imaging device 100 and option assembly 130, pick mechanisms 180 are illustrated in a position to drive a topmost media sheet from the media stack MST into media dam 172 which directs the picked sheet into media path P or extension PX. Bottom fed media trays may also be used. As is known, media dam 172 may or may not contain one or more separator rolls and/or separator strips used to prevent shingled feeding of media from media stack MST. Feed roll assemblies 174, comprised of two opposed rolls, feed media from an inferior unit to a superior unit via a slotted passageway provided therein.

In imaging device 100, a media path P (shown in dashed line) is provided from removable media input tray 170 extending through print engine 110 to output area 133 or to duplexer 135. Media path P may also have extensions PX and/or branches PB (shown in dotted line) from or to other removable media input trays as described herein such as that shown in option assembly 130. Media path P may include a multipurpose input tray 131 provided on housing 132 of imaging device 100 or incorporated into removable media tray 170 provided in housing 132 and a corresponding path branch PB that merges with the media path P within imaging device 100. Along media path P and its extensions PX are provided media position sensors 204 which are used to detect the position of the media, usually the leading and trailing edges of the media, as it moves along the media path P or path extension PX. Media position sensor 204 is located adjacent to the point at which media is picked from each of media trays 170. Media position sensor 204 in imaging device 100 also accommodates media fed along path branch PB from multipurpose media tray 131 and is illustrated at a position downstream of media tray 170 in imaging device 100. Additional media position sensors may be located throughout media path P and a duplex path 136, when provided, and their number and positioning is a matter of design choice. Media position sensors 204 may be an optical interrupter or a limit switch or other type of edge detector as is known to a person of skill in the art.

Media type sensors 207 are provided in imaging device 100 and each option assembly 130 to sense the type of media being fed from removable media input trays 170. Media type sensor 207 may include a light source, such as an LED and two photoreceptors. One photoreceptor is aligned with the angle of reflection of the light rays from the LED, receives specular light reflected from the surface of the sheet of media, and produces an output signal related to an amount of specular light reflected. The other photoreceptor is positioned off of the angle of reflection, receives diffuse light reflected from the surface of the media and produces an output signal related to the amount of diffused light received. Controller 101, by ratioing the output signals of the two photoreceptors at each media type sensor 207, can determine the type of media in the respective media tray 170.

Media size sensors 208 are provided in image forming device 100 and each option assembly 130 to sense the size of media being feed from removable media input trays 170. To determine media sizes such as Letter, A4, A6, Legal, etc., media size sensors 208 detect the location of adjustable trailing edge media supports and may in some cases detect one or both adjustable media side edge media supports provided within removable media input trays 170 as is known in the art. Sensors 204, 207 and 208 are shown in communication with controller 101 via communication link 145.

Figure 2:
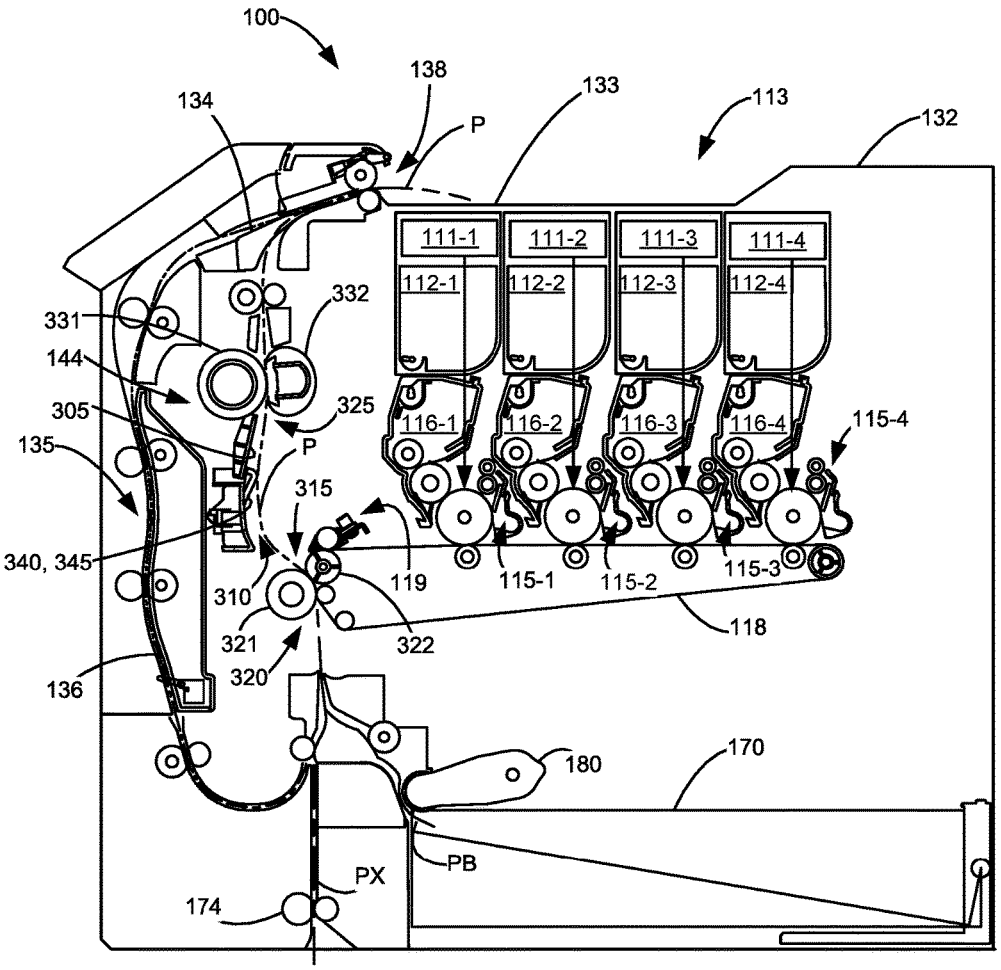
FIG. 2 illustrates an example imaging device of the imaging system in FIG. 1 according to one example embodiment.

Also shown on media path P in imaging device 100 is a media path assembly 300 comprised of a media guide 305 having a bubble chamber 310 therein (see FIG. 2). Media guide 305 is positioned between two adjacent nips, such as nips formed by a feed roll pair, belt pair, or combinations thereof. A first nip 315 formed by a roll pair 320 is positioned at an entrance to bubble chamber 310. In one example embodiment, first nip 315 comprises a transfer nip 315 formed by transfer roll pair 320 (See FIG. 2). First nip 315 is positioned in the media path to receive media sheets traveling along media path P from a media input tray 170 located within imaging device 100 and media sheets travelling along duplex path 136 in duplexer 135. A second nip 325 formed by a roll-belt pair 330 is positioned to receive media sheets exiting bubble chamber 310 (see FIG. 2). In one example embodiment, second nip 325 comprises a fuser nip formed by roll-belt pair 330 (See FIG. 2). Media roll pair 320 and roll-belt pair 330 are operatively coupled to respective motors 318, 328. Motors 318, 328 are in operative communication with controller 101 via communication link 145 and are used to control the rotational speed and direction of rotation of feed roll pair 320 and roll-belt pair 330, respectively. Positioned in the bubble chamber 310 of media guide 305 are first and second media sensors 340, 345, respectively. First and second media sensors 340, 345 are positioned adjacent to media guide 305 and are spaced apart and aligned relative to each other in a direction transverse to the media path P such that a media sheet entering the bubble chamber 310 contacts at least one of the first and second media sensors 340, 345. First and second media sensors 340, 345 are used to detect bubble formation and media size of the media sheet passing through bubble chamber 310 and, additionally, are provided to allow the leading edge of the media sheet exiting the first nip 315 to substantially align with the second nip 325 when entering the second nip 325, as will be discussed in greater detail below.

FIG. 2 illustrates imaging device 100 as a color imaging device 100 having media path assembly 300 therein. Four color cartridges 112-1 through 112-4 holding black, cyan, magenta and yellow colored toners, respectively, are positioned above intermediate transfer member (ITM) 118. LSU 111-1-111-4 are provided for each color. Corresponding developer units 116-1-116-4 and cleaner units 115-1-115-4 are positioned beneath cartridges 112-1-112-4, respectively. Transfer nip 315, shown at the left end of ITM 118 at which the toned image on ITM 118 will be transferred to a media sheet being fed, is formed between transfer roll pair 320 including a transfer roll 321 and a backup roll 322. Media guide 305 is positioned downstream of (above as shown in the figure) the transfer nip 315. Thereafter, the toned image will be fused to the media sheet as it passes through fuser 114 having fuser nip 325 formed between roll-belt pair 330 including a backup roll 331 and fuser belt 332. Provided the fused media is not undergoing duplex printing, the media sheet would then be fed past gate 134 to output area 133 via an exit roll pair 138. During duplexing, the fused media sheet would be held by exit roll pair 138 and gate 134 would be shifted so that the trailing edge of the fused media sheet would enter duplex path 136 and become the leading edge of the fused media sheet as it is transferred back media path P. A cleaner unit 119 is positioned downstream of transfer nip 315 relative to a clockwise rotation of ITM 118 to remove remaining particles of toner from the outer surface of ITM 118 that has not been transferred onto the media sheet at transfer nip 315.

Figure 3:
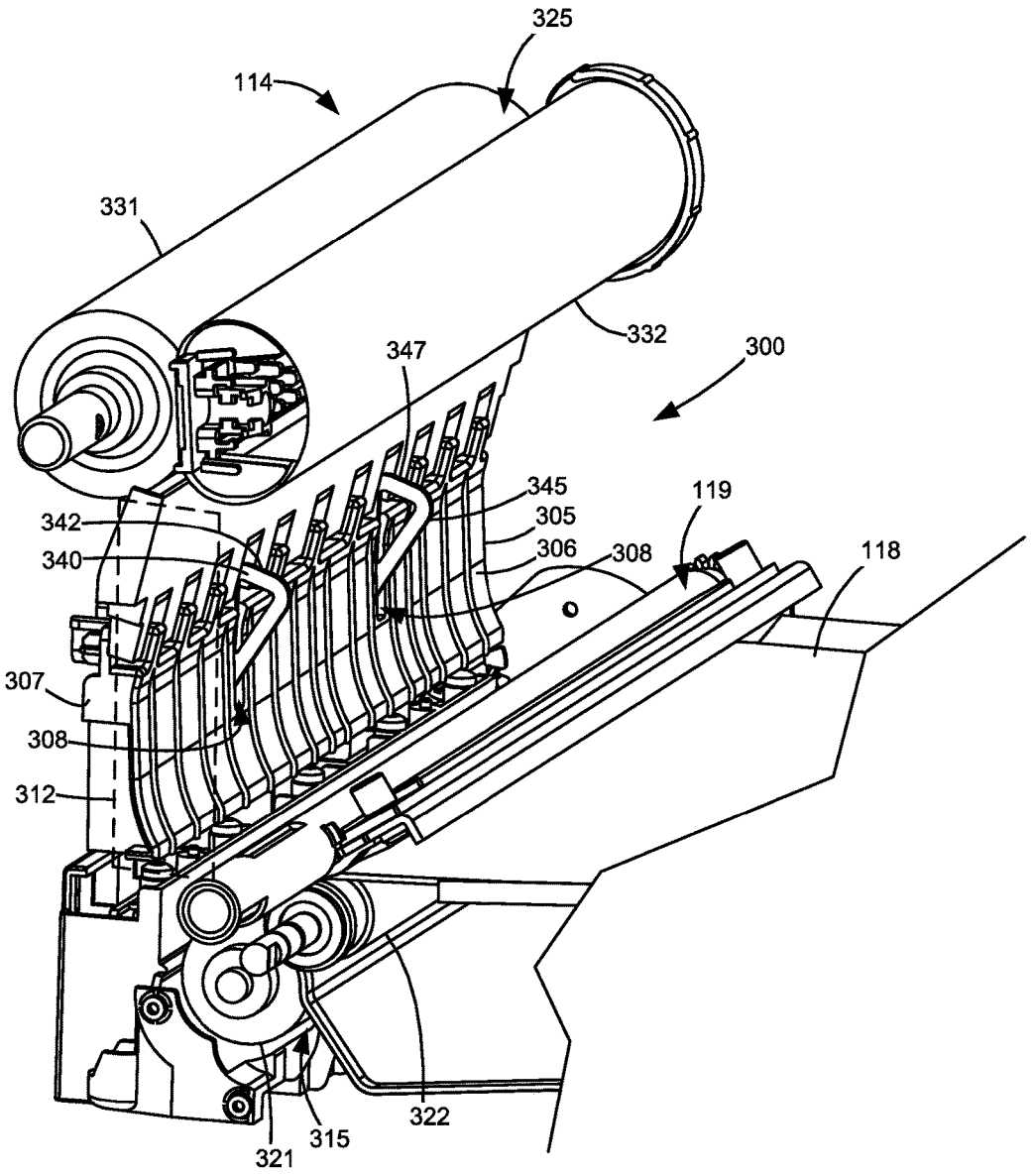
FIG. 3 is a perspective view of a media path assembly of the imaging device in FIG. 2.
Figure 4:
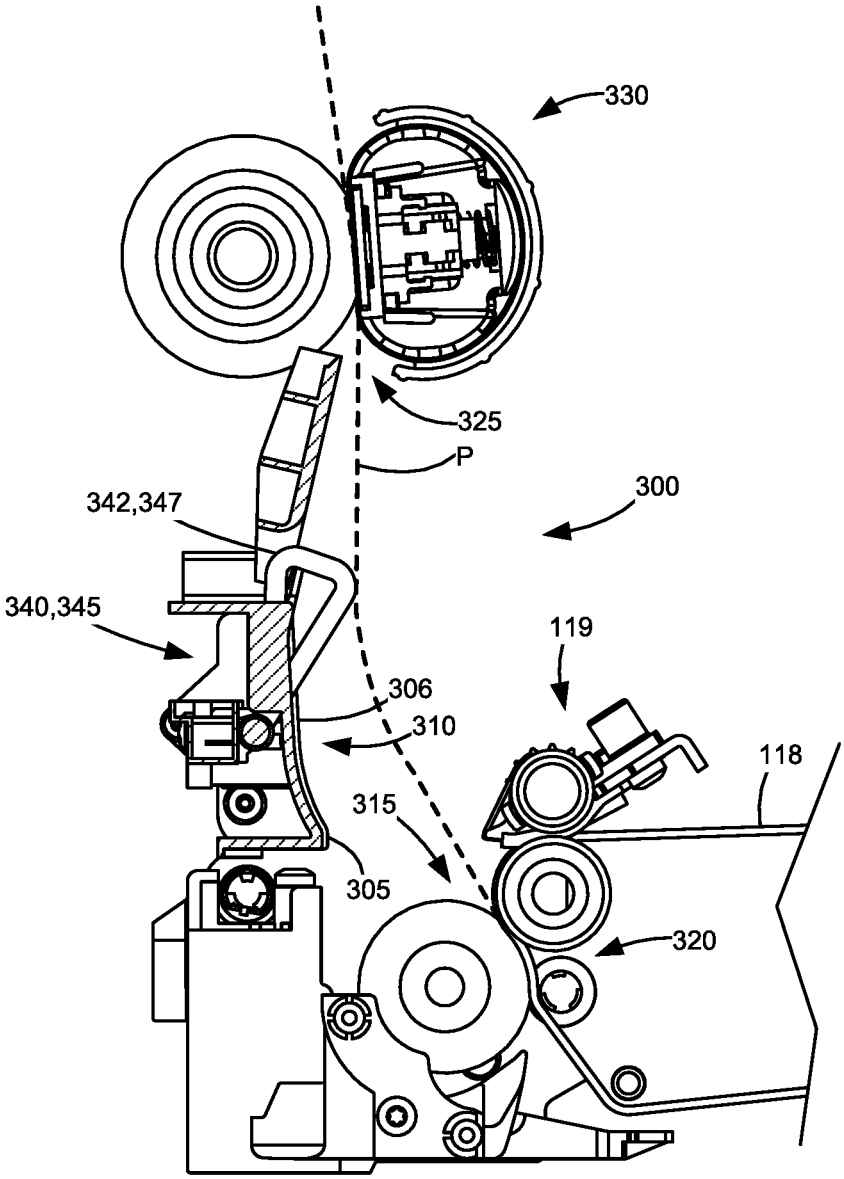
FIG. 4 is a side view of the media path assembly illustrated in FIG. 3.

Referring to FIGS. 3-4, media guide 305 is shown positioned adjacent and transverse to a portion of media path P between transfer nip 315 and fuser nip 325 to direct a leading edge of a media sheet exiting transfer nip 315 into the fuser nip 325. In one example embodiment, a distance along the media path P from transfer nip 315 to fuser nip 325 may be less than a length of a typical media sheet such that the media sheet may simultaneously traverse and be present in both transfer nip 315 and fuser nip 325 at the same time. First and second media sensors 340, 345 are positioned transverse to the media path and aligned with each other and, in one example, may be provided approximately midway between transfer nip 315 and fuser nip 325. Depending on media size, the media sheet exiting transfer nip 315 contacts at least one of first media sensor 340 and second media sensor 345 as the media sheet exits transfer nip 315 and moves toward fuser nip 325.

Media guide 305 has a curved guide surface 306 forming bubble chamber 310 adjacent and across the media path. Features of curved guide surface 306 allow media guide 305 to direct a media sheet exiting transfer nip 315 into fuser nip 325 and, while the media sheet simultaneously traverses transfer nip 315 and fuser nip 325, allow the media sheet to buckle in a desired direction, i.e., into bubble chamber 310 (See, for example, FIG. 10D) and form a bubble. If the fusing speed at fuser nip 325 is faster than the media process speed at transfer nip 315, the bubble in the media sheet may be eliminated and the media sheet may be dragged by the fuser nip 325 through toner transfer nip 315 which may result in print defects. On the other hand, an excessive bubble on the media sheet may cause the trailing edge of the media sheet to flip and contact cleaner unit 119 which may result in transfer of waste toner from cleaner unit 119 to the media sheet. Accordingly, controller 101 monitors and controls the movement of the media sheet along media path P based at least on the outputs of first and second media sensors 340, 345 to maintain a bubble in the media sheet within a desired range of depth that avoids print defects, waste toner transfer, and other deleterious effects. In one example, controller 101 independently controls rotation of each motor 318, 328 to control the relative speeds at the transfer nip 315 and fuser nip 325 so as to maintain a desired bubble size of the bubble in the media sheet. As will be appreciated, desired bubble depth may vary with media weight, thickness, and/or stiffness. When adjusting bubble depth, the media process speed/transfer speed at the transfer nip 315 and the fusing speed at the fuser nip 325 may or may not match, i.e., the media sheet may move at a different speed through the fuser nip 325 than it moves through the transfer nip 315. For example, the transfer speed may be held constant and the fusing speed may be varied to adjust the bubble depth of the bubble in the media sheet.

A reference edge surface 312 (shown in dashed lines in FIG. 3), along which a side edge of a media sheet exiting the transfer nip 315 rides, is positioned along a side of the media path adjacent a side 307 of media guide 305. Reference edge surface 312 is vertically aligned with respective reference edge surfaces included in media input trays 170 and other reference edge surfaces within housing 132 of imaging device 100 that are used to guide media sheets to print engine 110.

Figure 5:
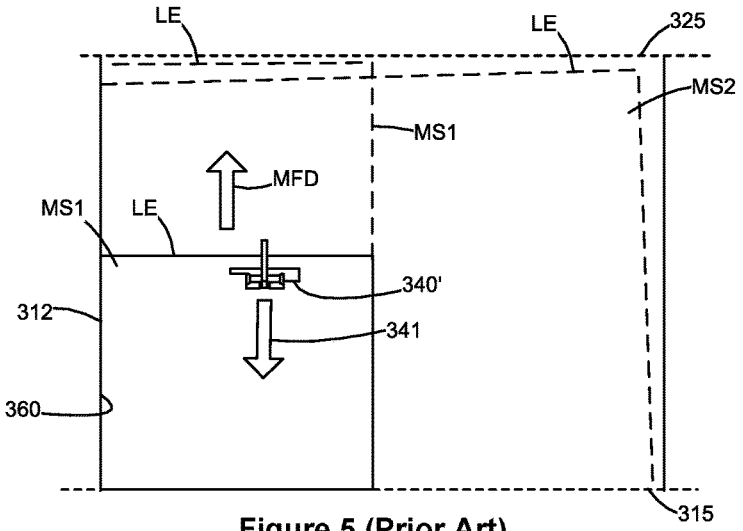
Figure 5 (Prior Art)
FIG. 5 is an illustrative view of a bubble sensor position in a prior art reference edge type system.

In a prior art reference edge type system as depicted in FIG. 5, side edges 360 of a narrowest supported media MS1 and a widest supported media MS2 ride along a reference edge 312 when fed from transfer nip 315 to fuser nip 325. A media sensor 340' used as a bubble sensor 340' is disposed at a fixed position across the media path that is laterally offset toward reference edge 312 from a center of gravity (or centerline) of widest supported media MS2 such that bubble sensor 340' is contacted by both narrowest supported media MS1 and widest supported media MS2 when passing through the media path in the media feed direction MFD and moving from transfer nip 315 to fuser nip 325. While this prior art arrangement generally allows bubble detection by bubble sensor 340 from the narrowest supported media MS1 to the widest supported media MS2, feed reliability of wider media sheet sizes may be compromised. When a media sheet exiting transfer nip 315 contacts bubble sensor 340' and is fed towards fuser nip 325 in media feed direction MFD, bubble sensor 340' creates a drag force 341 on the media sheet acting opposite to the media feed direction MFD which induces skewing of the media sheet. For narrower media, the drag force 341 created by bubble sensor 340' is located relatively close to or about the center of gravity of the media sheet such that skewing of the media sheet is negligible and the leading edge LE thereof, when entering fuser nip 325, is closely or substantially aligned with fuser nip 325. However, for wider media sheet sizes, skewing becomes more objectionable when the lateral offset arrangement between the drag force 341 imparted by bubble sensor 340' and the center of gravity of the media sheet becomes relatively larger as media width increases. Skewing would be relatively largest for the widest supported media as the lateral offset is largest for the widest supported media. For example, widest supported media MS2 shown in FIG. 6 has a leading edge LE that is skewed relative to fuser nip 325 just prior to entering fuser nip 325 due to the drag force 341 being laterally offset a significant amount of distance from the center of gravity of widest supported media MS2. Skewed media sheets upon entering fuser nip 325 can cause print defects such as treeing (i.e., crease lines in the media sheet) and milky defect (i.e., areas of light print). To improve feed reliability between transfer nip 315 and fuser nip 325 in reference edge type systems, it is desired to reduce the unbalanced application of drag force on a media sheet exiting transfer nip 315 and entering fuser nip 325 regardless of media width.

Figure 6:
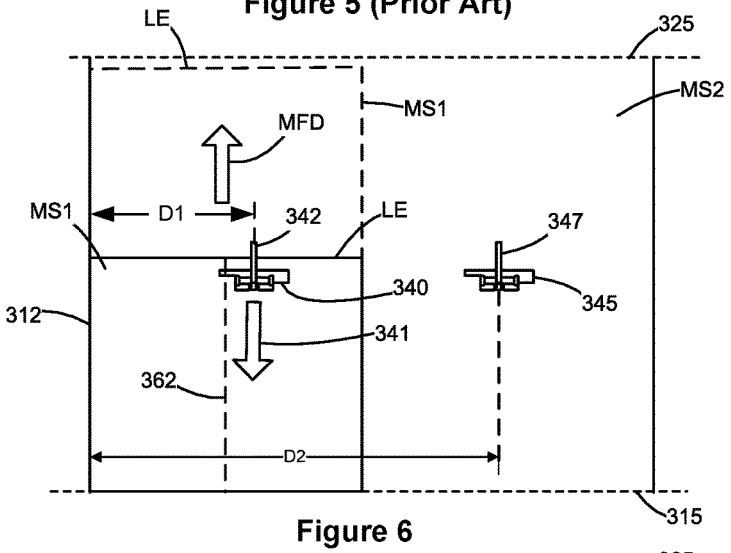
FIGS. 6 and 7 are schematic illustrations showing a bubble sensor and a narrow media sensor positioned transverse to a media path of the imaging device according to one example embodiment.
Figure 7:
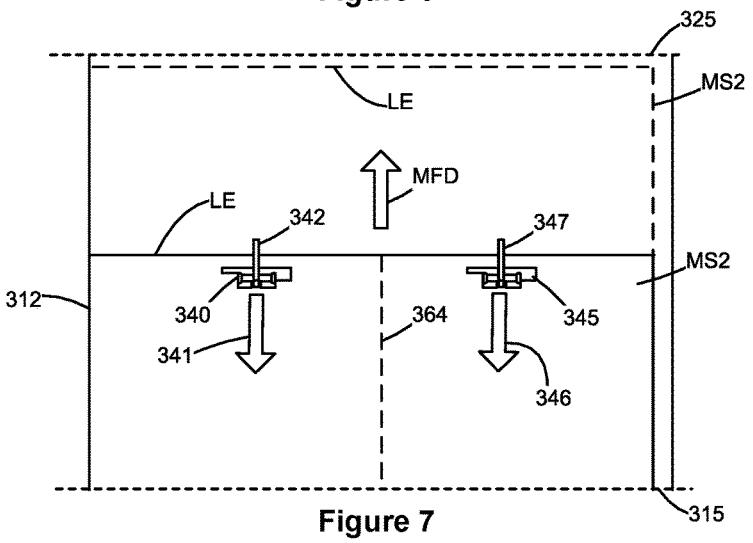

In accordance with example embodiments of the present disclosure, first and second media sensors 340, 345 are provided adjacent to media guide 305 and substantially aligned with each other across and transverse to media path P in such a way as to reduce any skewing forces on the media sheet exiting transfer nip 315 as the leading edge of the media sheet enters fuser nip 325. With reference to FIGS. 6-7, first media sensor 340 is positioned at a first distance D1 from reference edge surface 312 and second media sensor 345 is positioned at a second distance D2 greater than the first distance D1 from reference edge surface 312. First and second media sensors 340, 345 are, in one form, flag assemblies including optical interrupter type sensors each having a spring-biased flag arm 342, 347 projecting through a corresponding opening 308 in media guide 305 and positioned in bubble chamber 310. In one example embodiment, the spring-biased flag arms 342, 347 are substantially identical. In one example form, flag arms 342, 347 each has a fan-shaped arm as shown in order to avoid any catch points when a media sheet is removed out of media path assembly 300, such as when clearing a paper jam, and to provide stiffness and strength to flag arms 342, 347. The position of second media sensor 345 corresponds to a location in media guide 305 at which wide media sheet MS2 of a first media size contacts flag arm 347 of second media sensor 345 when wide media sheet MS2 passes through media path P and at which flag arm 347 of second media sensor 345 is not contacted by narrow media sheet MS1 of a second media size that is less than the first media size when narrow media sheet MS1 passes through the media path P. Meanwhile, the position of first media sensor 340 corresponds to a location in media guide 305 at which both wide media sheet MS2 and narrow media sheet MS1 contact flag arm 342 of first media sensor 340 when passing through media path P. Two media sheet sizes are presented only for purposes of illustration and, thus, should not be considered limiting. In general, the position of first media sensor 340 may correspond to a location in media guide 305 at which media sheets of different sizes (i.e., both narrow and wide media) supported by imaging device 100 may contact flag arm 342 of first media sensor 340, and the position of second media sensor 345 may correspond to a location in media guide 305 at which one or more relatively wide media sheets supported by imaging device 100 contact flag arm 347 of second media sensor 345 and at which one or more relatively narrow media sheets do not contact flag arm 347.

In one example embodiment, first media sensor 340 is used for detecting bubble formation in the media sheet exiting transfer nip 315 and second media sensor 345 is used for detecting a media size of the media sheet exiting transfer nip 315. The first media sensor 340 and second media sensor 345 are hereinafter referred to as bubble sensor 340 and narrow media sensor 345, respectively. Positioning of the bubble sensor 340 and narrow media sensor 345 are selected to reduce unbalanced application of drag forces on media sheets exiting transfer nip 315. For example, as shown in FIG. 6 illustrating narrow media sheet MS1 contacting only bubble sensor 340, the drag force 341 created by bubble sensor 340 is located relatively close to a centerline 362 of narrow media sheet MS1 such that skewing of narrow media sheet MS1 is reduced and the leading edge LE thereof is closely aligned with fuser nip 325 when entering fuser nip 325 as shown in dashed lines. In FIG. 7, wide media sheet MS2 contacts both bubble sensor 340 and narrow media sensor 345 after exiting transfer nip 315 and the drag forces 341, 346 created by the bubble and narrow media sensors 340, 345, respectively, are located at opposite sides of a centerline 364 of wide media sheet MS2 such that skewing of wide media sheet MS2 is reduced and the leading edge LE thereof is closely or substantially aligned with fuser nip 325 just prior to entering fuser nip 325 as shown in dashed lines.

Figure 8:
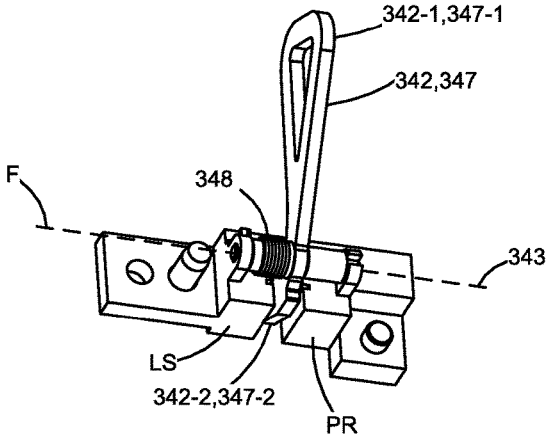
FIG. 8 is a perspective view of the bubble sensor and the narrow media sensor according to one example embodiment.
Figure 9:
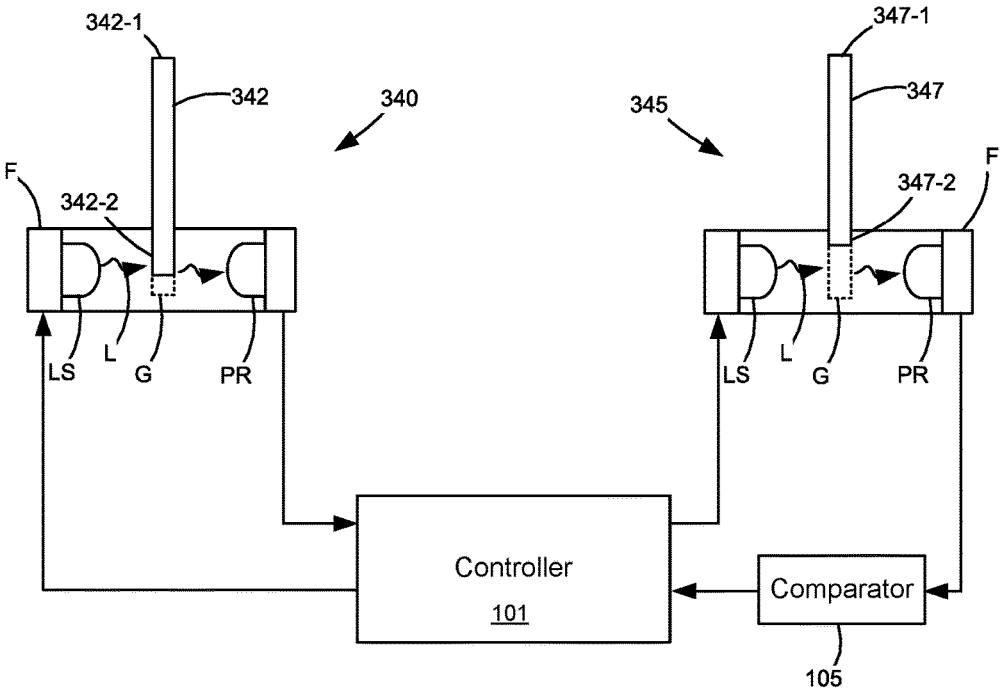
FIG. 9 is a schematic illustration showing operation of the bubble sensor and the narrow media sensor according to one example embodiment.

FIG. 8 illustrates an example embodiment of each of the bubble and narrow media sensors 340, 345 and FIG. 9 illustrates operation of one form of sensors 340, 345. Bubble and narrow media sensors 340, 345 each has a frame F on which are mounted a light source LS and photoreceptor PR having a gap G therebetween. Light source LS may be a LED or an infrared LED. Flag arm 342, 347 is pivotably mounted to frame F for pivotal movement about a pivot axis 343. Flag arm 342, 347 has a first end 342-1, 347-1 that is contacted by a media sheet exiting transfer nip 315 and a second end 342-2, 347-2 that moves between light source LS and photoreceptor PR into or out of an optical path therebetween as flag arm 342, 347 pivots about pivot axis 343. Each of the sensors 340, 345 outputs an analog signal corresponding to the intensity of light received by the photoreceptor PR. As flag arm 342, 347 rotates, the respective second end 342-2, 347-2 thereof enters and exits gap G causing the output of sensor 340, 345 to change according to the position of second end 342-2, 347-2 relative to the optical path of sensor 340, 345. Flag arm 342-2, 347-2 is biased by a torsion spring 348 to rotate in a direction that moves the first end 342-1, 347-1 towards and into bubble chamber 310 extending through the corresponding opening 308 in media guide 305. When the first end 342-1, 347-1 is contacted by the media sheet exiting transfer nip 315, the media sheet causes flag arm 342, 347 to rotate against the biasing force of torsion spring 348. The media sheet exiting transfer nip 315, while in contact with flag arm 342, 347 causes rotational movement of flag arm 342, 347 and changes the output levels of sensors 340, 345 according to the position of the second end 342-2, 347-2 relative to the optical path of sensors 340, 345. In one example embodiment, the spring force of bubble sensor 340 and narrow media sensor 345 substantially matches each other so that the respective drag forces applied by each sensor 340, 345 on the media sheet match each other to allow the media sheet to be fed into the fuser nip 325 substantially without skew.

Figure 15:
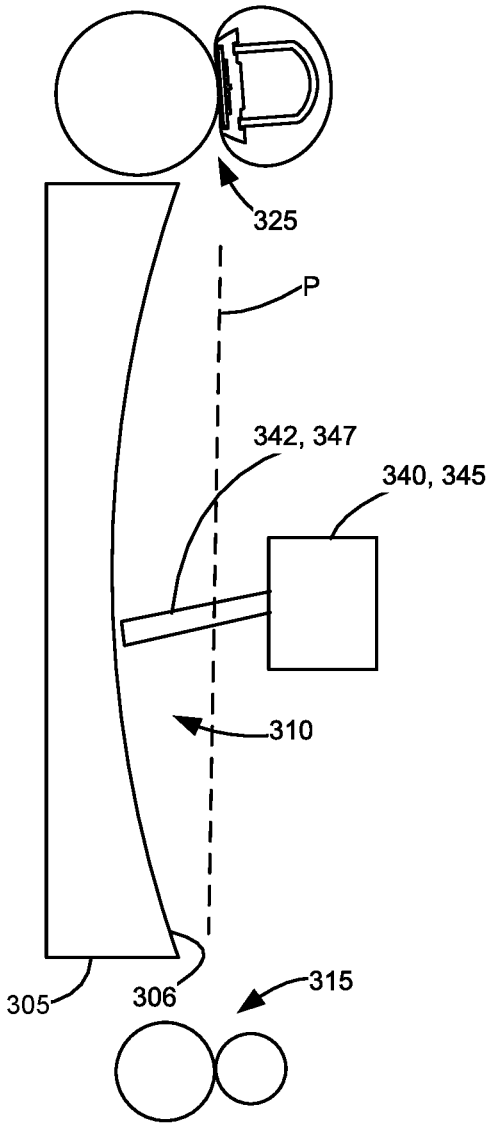
FIG. 15 is an illustration of the bubble sensor and the narrow media sensor according to another example embodiment.

The present disclosure is not limited to the specific embodiments of bubble sensor 340 and narrow media sensor 345 illustrated in FIGS. 2-4. Rather, bubble sensor 340 and narrow media sensor 345 may be of any suitable construction and/or arrangement that allow for flag arms 342, 347 to contact and be deflected by media sheets being fed between transfer nip 315 and fuser nip 325. For example, FIG. 15 shows bubble sensor 340 and narrow media sensor 345 being provided in bubble chamber 310 facing guide surface 306 of media guide 305 with flag arms 342, 347 extending towards media guide 305. Flag arms 342, 347 are positioned such that they are deflected in a clockwise direction from their initial positions upon being contacted by a media sheet exiting transfer nip 315 and moving towards fuser nip 325.

In one example embodiment, the analog output of bubble sensor 340 is used to determine bubble depth of the bubble formed in the media sheet along media guide 305 whereas the analog output of narrow media sensor 345 is converted into a digital output which is then used in determining media size. In FIG. 9, controller 101 is shown coupled to bubble sensor ix) 340 and narrow media sensor 345, and is configured to communicate therewith to control activation of light source LS and receive signals from photoreceptor PR. Additional circuitries on board may also be used to convert signals into forms suitable for use by controller 101 and/or sensors 340, 345. In operation, controller 101 generates a signal for driving light source LS to emit light beam L and photoreceptor PR generates an analog output signal based on the amount of optical energy it receives. For bubble sensor 340, controller 101 receives the analog output S1 (See FIGS. 12 and 13) corresponding to the output signal of photoreceptor PR and analyzes the analog output S1 to determine the bubble depth of the bubble in the media sheet. For example, controller 101 may sample the analog output S1 and use the amplitude of the sampled analog output to determine bubble depth. For narrow media sensor 345, the analog signal that is outputted by photoreceptor PR, which would follow the same signal pattern of analog output S1 when wide media is fed, may be received by a comparator circuit 105 which produces a digital output S2 (See FIGS. 12 and 13) having either a first state when the analog signal falls below a predetermined level and a second state when the analog signal exceeds the predetermined level. For example, as flag arm 347 of narrow media sensor 345 enters and exits gap G, the output signal of narrow media sensor 345 changes from one state to another. With the light beam L blocked, the output signal of the narrow media sensor 345 falls below the predetermined level and may be described as being in the first state (e.g., low state LO in FIG. 13). With the light beam L unblocked, the output signal of narrow media sensor 345 exceeds the predetermined level and may be described as being in the second state (e.g., high state HI in FIG. 13). As will be appreciated, reverse logic to that described may also be used. For example, alternative embodiments may incorporate sensor circuitries which generate output that is in a high state when the optical path is blocked and in a low state when the optical path is unblocked.

Figure 12:
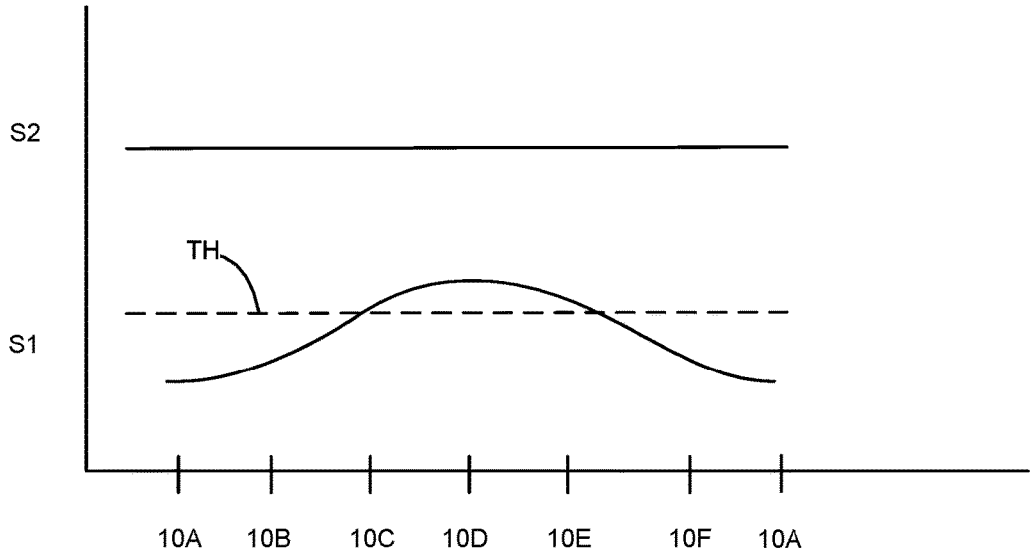
FIG. 12 is a timing diagram illustrating an analog output and a digital output corresponding to the output signals of the bubble sensor and the narrow media sensor, respectively, when the narrow media sheet shown in FIGS. 10A-10F is fed, according to one example embodiment.

FIGS. 10A-10F illustrate the feeding of narrow media sheet MS1 into media path assembly 300 from transfer nip 315 to fuser nip 325. FIG. 12 shows the analog output S1 and digital output S2 corresponding to the positions of flag arms 342, 347 of bubble sensor 340 and narrow media sensor 345, respectively, shown in FIGS. 10A-10F as narrow media sheet MS1 is fed from transfer nip 315 to fuser nip 325. In the examples that follow, each of the flag arms 342, 347 of bubble sensor 340 and narrow media sensor 345 initially blocks the optical path between light source LS and photoreceptor PR resulting in a low output signal of photoreceptor PR when no media sheet is being fed along media path assembly 300. When a media sheet is fed along media path assembly 300 and deflects flag arm 342, 347, second end 342-2, 347-2 thereof moves out of the optical path resulting in an increase in the output signal of photoreceptor PR. For the following description, it should also be understood that controller 101 is controlling the rotational speed of transfer roll pair 320 and the rotation speed of roll-belt pair 330 via respective motors 318, 328. Controller 101 is also communicatively coupled with and receives output signals from bubble sensor 340 and narrow media sensor 345.

Figure 10A:
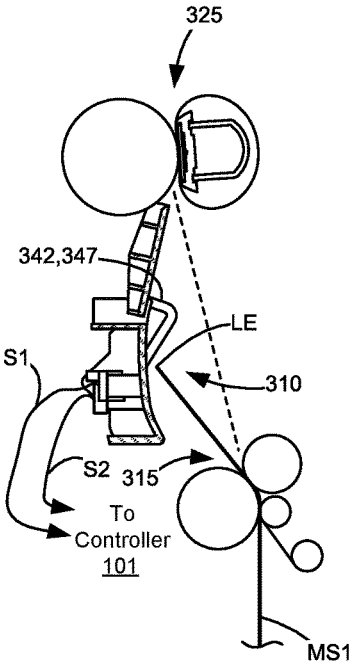
FIGS. 10A-10F illustrate bubble formation in the media path assembly where a narrow media sheet is fed from a toner transfer nip to a fuser nip, according to one example embodiment.
Figure 10B:
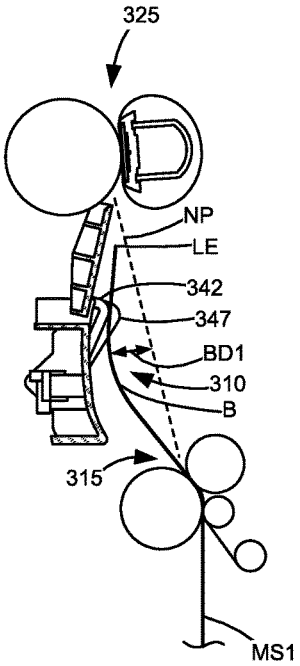

In FIG. 10A, flag arms 342, 347 are positioned across media guide 305 in their initial positions. As narrow media sheet MS1 is fed from transfer nip 315 into bubble chamber 310, a leading edge LE of narrow media sheet MS1 contacts flag arm 342 of bubble sensor 340 without contacting flag arm 347 of narrow media sensor 345. The state of the analog output S1 and digital output S2 of bubble sensor 340 and narrow media sensor 345, respectively, are shown at 10A in FIG. 12. As feeding of narrow media sheet MS1 continues, narrow media sheet MS1 deflects flag arm 342 of bubble sensor 340 as shown in FIG. 10B causing flag arm 342 to rotate and the analog output S1 to increase as indicated at 10B in FIG. 12. Because flag arm 347 of narrow media sensor 345 is not contacted by narrow media sheet MS1, the digital output S2 thereof remains unchanged at 10B.

Figure 10C:
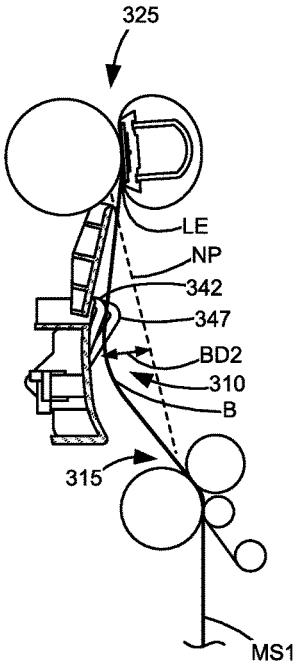

As narrow media sheet MS1 is fed, flag arm 342 of bubble sensor 340 causes a portion of narrow media sheet MS1 to start buckling into bubble chamber 310 and form a bubble B having a bubble depth BD1 relative to a nominal media path NP, indicated by a dashed line between transfer nip 315 and fuser nip 325, which depicts a media sheet with no bubble formation. Thereafter, the leading edge LE is directed into fuser nip 325. Narrow media sheet MS1 may, in some cases, contact surface 306 of media guide 305 and move therealong so as to be directed into fuser nip 325. As transfer roll pair 320 continues to feed narrow media sheet MS1, the leading edge LE enters fuser nip 325, as shown in FIG. 10C, and bubble B grows to a bubble depth BD2 which further deflects flag arm 342 resulting in an increase in the analog output S1 as indicated at 10C in FIG. 12.

Figure 10D:
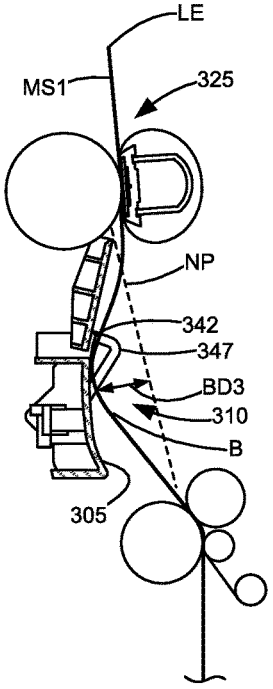
Figure 10E:
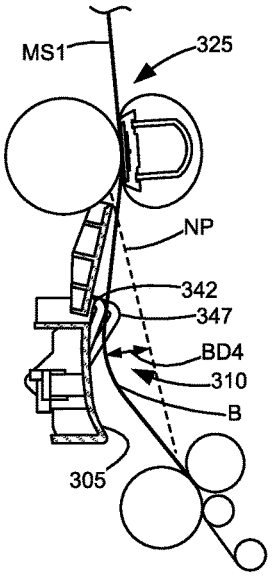

In FIG. 10D, narrow media sheet MS1 has been fed to the position where the leading edge LE has entered and moved past fuser nip 325 such that narrow media sheet MS1 simultaneously traverses transfer nip 315 and fuser nip 325. As both transfer roll pair 320 and roll-belt pair 330 continue to feed narrow media sheet MS1, bubble B grows to a bubble depth BD3 further deflecting flag arm 342 and causing the analog output S1 of bubble sensor 340 to increase as indicated at 10D in FIG. 12. This may be the case when narrow media sheet MS1 is fed by transfer roll pair 320 at a rate that is faster than the rate at which roll-belt pair 330 feeds narrow media sheet MS1. When the analog output S1 reaches a predetermined threshold, such as indicated by a dashed line TH in FIG. 12, controller 101 recognizes that bubble B in narrow media sheet MS1 has exceeded a predetermined threshold or range. Accordingly, controller 101 controls at least one of the media process speed at transfer nip 315 and the fusing speed at fuser nip 325 to reduce the size of bubble B in narrow media sheet MS1. In particular, controller 101 varies the speed of at least one of motors 318, 328 to adjust the relative speeds between transfer roll pair 320 and roll-belt pair 330. In general, decreasing bubble size may be done by controlling transfer roll pair 320 to have a rotational speed that is less than a rotational speed of the roll-belt pair 330, or, conversely, roll-belt pair 330 to have a rotational speed that is greater than the rotational speed of transfer roll pair 320. For example, to decrease bubble size, the rotational speed of the roll-belt pair 330 may be held constant while the rotational speed of the transfer roll pair 320 is decreased to be slower than the rotational speed of roll-belt pair 330. Also, for example, the rotational speed of the transfer roll pair 320 may be held constant while the rotational speed of the roll-belt pair 330 is increased to be faster than the rotational speed of the transfer roll pair 320. By controlling roll-belt pair 330 to have a rotational speed that is greater than the rotational speed of transfer roll pair 320, the size of bubble B in narrow media sheet MS1 decreases to a bubble depth BD4, as shown in FIG. 10E, thereby decreasing the amount of deflection of flag arm 342 and causing the analog output S1 to decrease as indicated at 10E in FIG. 12. In one example, once the bubble B deflates to a depth within the predetermined range, the speeds of the transfer roll pair 320 and roll-belt pair 330 may be matched to prevent further bubble growth or deflation. It will be appreciated that desired bubble depth may vary for different media types.

It will be understood that when the media sheet MS is being fed by both transfer roll pair 320 and roll-belt pair 330, bubble growth and deflation of the bubble in the media sheet may, in some cases, occur several times. Accordingly, controller 101 continues to monitor the bubble depth based on the analog output S1 of bubble sensor 340 and varies the relative speeds of transfer roll pair 320 and roll-belt pair 330 when feeding narrow media sheet MS1 to either increase or decrease bubble growth so as to maintain the bubble depth within a desired range. For example, if the bubble depth exceeds a first predetermined size, controller 101 may perform one or more actions to decrease the bubble size as previously described. On the other hand, if the bubble depth falls below a second predetermined level less than the first predetermined level, controller 101 may provide instructions to increase the bubble size. To increase bubble size, the respective speeds of transfer roll pair 320 and roll-belt pair 330 would be reversed relative to the actions performed in decreasing bubble size.

By using the analog output S1 of bubble sensor 340 as opposed to using a digital signal (as with the case for narrow media sensor 345), bubble depth may be adjusted in real time to be optimized for various media types. In one example, tail flipping of the trailing edge of the media sheet may be mitigated by providing a deeper bubble size to keep the trailing edge of the media sheet from getting too close to cleaner unit 119 during exit from transfer nip 315, or by providing a more shallow bubble size to limit the swinging of the trailing edge away from and then into cleaner unit 119. In general, the ideal bubble depth can vary with media weight such that having the ability to adjust bubble depth based on the analog output S1 of bubble sensor 340 would result in a more robust system.

Figure 10F:
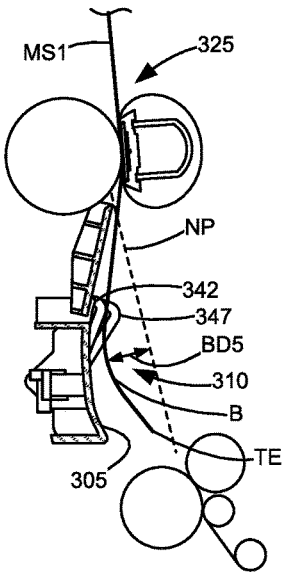

In FIG. 10F, the trailing edge TE of narrow media sheet MS1 has exited transfer nip 315 and fuser nip 325 will continue to feed the remainder of narrow media sheet MS1 out of bubble chamber 310. As roll-belt pair 330 continues to feed narrow media sheet MS1 out of bubble chamber 310, the size of bubble B deflates which decreases the amount of deflection of flag arm 342 and causes the analog output S1 to decrease as indicated at 10F in FIG. 12. When narrow media sheet MS1 has moved to an extent that the trailing edge TE thereof no longer contacts flag arm 342, flag arm 342 returns to its initial position as shown in FIG. 10A and the analog output S1 decreases as indicated at 10A in FIG. 12.

For the media positions of narrow media sheet MS1 shown in FIGS. 10A through 10F, the digital output S2 of narrow media sensor 345 does not change as shown at 10A through 10F in FIG. 12 since narrow media sheet MS1 does not contact flag arm 342 of narrow media sensor 345. In one example embodiment, controller 101 recognizes that media sheet MS1 comprises narrow media when there is no change of state in the digital output S2 of narrow media sensor 345 during feeding of the media sheet.

Figure 13:
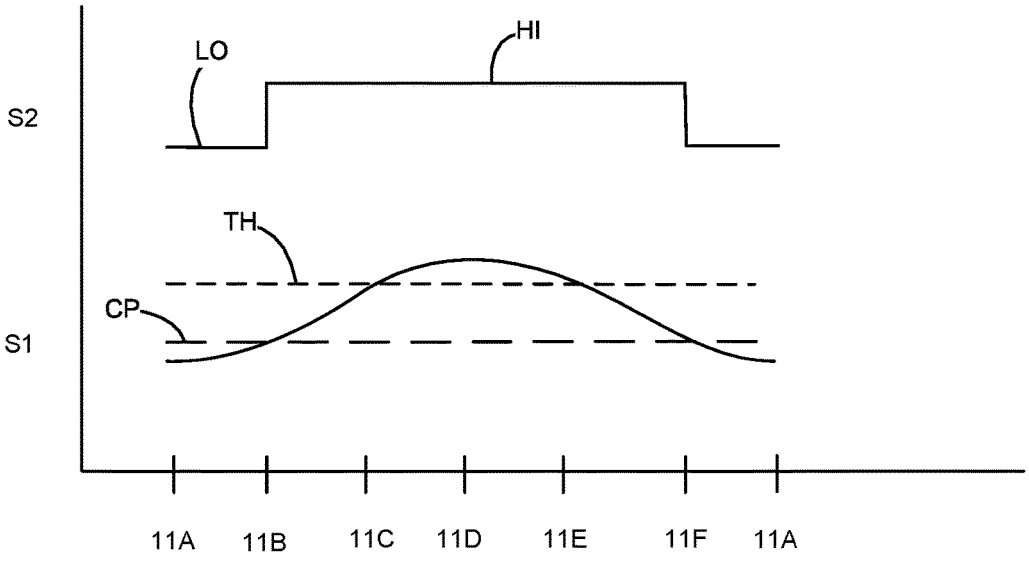
FIG. 13 is a timing diagram illustrating the analog output and the digital of the bubble sensor and the narrow media sensor, respectively, when the wide media sheet shown in FIGS. 11A-11F is fed, according to one example embodiment.

FIGS. 11A-11F illustrate the feeding of wide media sheet MS2 into media path assembly 300 from transfer nip 315 to fuser nip 325. FIG. 13 shows the analog output S1 and digital output S2 corresponding to the positions of flag arms 342, 347 of bubble sensor 340 and narrow media sensor 345, respectively, shown in FIGS. 11A-11F as wide media sheet MS2 is fed from transfer nip 315 to fuser nip 325. In the examples illustrated, the media positions of wide media sheet MS2 shown in FIGS. 11A-11F correspond to the media positions of narrow media sheet MS1 shown in FIGS. 10A-10F, respectively, such that each of flag arms 342, 347 moves relative to wide media sheet MS2 in a similar manner as described above with respect to flag arm 342 in FIGS. 10A-10F. Accordingly, the signal pattern of analog output S1 of bubble sensor 340 in FIG. 13 when wide media sheet MS2 is fed is the same as the signal pattern of analog output S1 in FIG. 12 when narrow media sheet MS1 is fed. On the other hand, the digital output S2 of narrow media sensor 345 in FIG. 13 changes since flag arm 347 of narrow media sensor 345 is now contacted by wide media sheet MS2, as opposed to not being contacted by narrow media sheet MS1 in the examples shown in FIGS. 10A-10F.

Figure 11A:
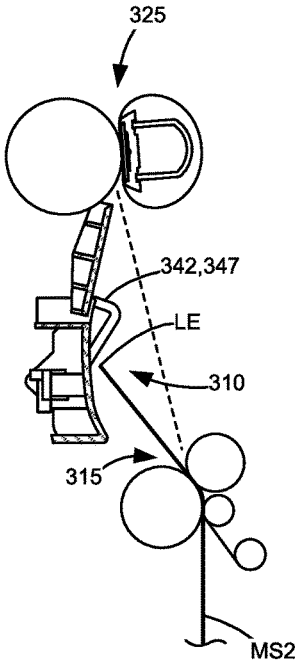
FIGS. 11A-11F illustrate bubble formation in the media path assembly where a wide media sheet is fed from a toner transfer nip to a fuser nip, according to one example embodiment.
Figure 11B:
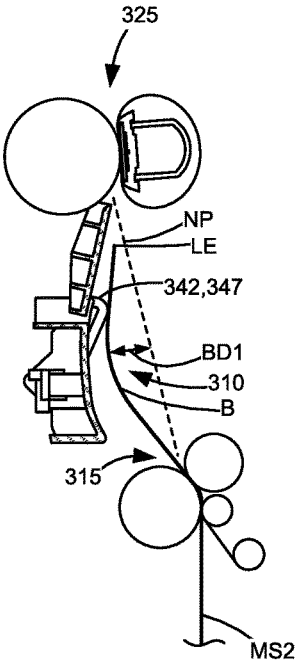
Figure 11C:
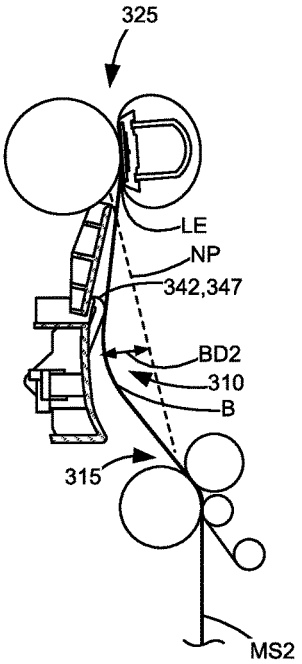
Figure 11D:
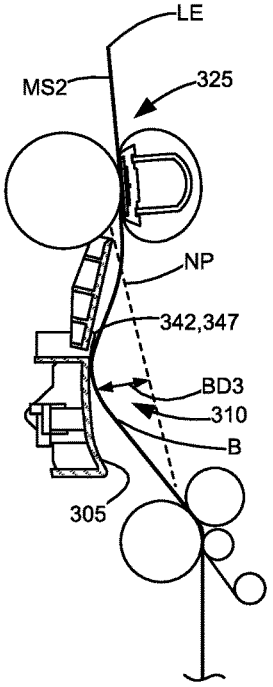
Figure 11E:
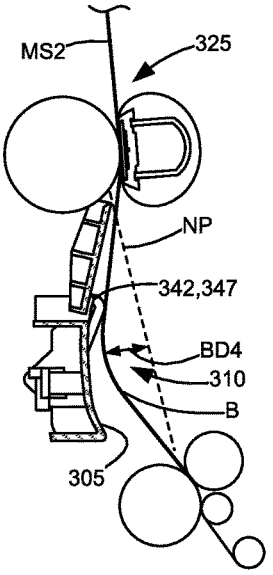
Figure 11F:
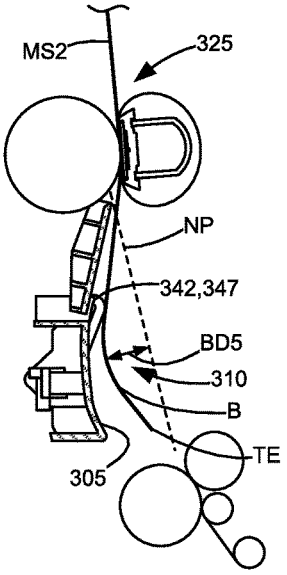

In FIG. 11A, flag arms 342, 347 are positioned across media guide 305 in their initial positions. The state of the analog output S1 and digital output S2 of bubble sensor 340 and narrow media sensor 345, respectively, are shown at 11A in FIG. 13, with the state of digital output S2 of narrow media sensor 345 being in a first state (LO). As wide media sheet MS2 is fed from transfer nip 315 into bubble chamber 310, a leading edge LE of wide media sheet MS2 contacts both flag arms 342, 347 of bubble sensor 340 and narrow media sensor 345, respectively, moving flag arms 342, 347 from their initial positions and actuating both bubble sensor 340 and narrow media sensor 345. In FIG. 11B, leading edge LE of wide media sheet MS2 has moved past flag arms 342, 347 and wide media sheet MS2 has moved flag arm 347 to a position where the digital output S2 of narrow media sensor 345 has changed to a second state (HI) as indicated at 11B in FIG. 13. For example, when the analog output S1 reaches a predetermined comparator threshold, such as indicated by a dashed line CP in FIG. 13, digital output S2 transitions from the first state (LO) to the second state (HI). In one example, the predetermined comparator threshold CP is below the predetermined threshold TH to ensure media size sensing before the bubble in the media sheet exceeds the desired range of depth. Controller 101 recognizes this change of state in digital output S2 of narrow media sensor 345 as an indication that media sheet MS2 comprises wide media.

In FIGS. 11C through 11F, transfer roll pair 320 and/or roll-belt pair 330 continue to feed wide media sheet MS2 and the state of digital output S2 of narrow media sensor 345 remains in the second state (HI) while wide media sheet MS2 remains in contact with flag arm 347 of narrow media sensor 345. Bubble growth and deflation may occur several times during the feeding of wide media sheet MS2 when feeding is occurring from both transfer roll pair 320 and roll-belt pair 330, and controller 101 is operative to adjust the relative speeds at the transfer nip 315 and fuser nip 325 to maintain a desired bubble depth as previously described. When the analog output S1 falls below the comparator threshold CP, digital output S2 of narrow media sensor 345 changes back to its first state as indicated at 11F in FIG. 13. When wide media sheet MS2 has moved to an extent that the trailing edge TE thereof no longer contacts flag arm 347, flag arm 347 returns to its initial position shown in FIG. 11A.

Since both flag arms 342, 347 of bubble sensor 340 and narrow media sensor 345, respectively, are positioned across the media path and contacting wide media sheet MS2 on opposed sides of the centerline thereof during feeding, skewing of wide media sheet MS2 when entering fuser nip 325 is reduced. In particular, by providing narrow media sensor 345 on a side opposite to bubble sensor 340 relative to the centerline of wide media sheet MS2, narrow media sensor 345 applies a drag force to wide media sheet MS2 to balance out the drag force applied by bubble sensor 340 such that wide media sheet MS2 is supported more evenly for a more symmetric entry into fuser nip 325.

In addition to balancing out the drag force of bubble sensor 340, narrow media sensor 345 is also used to sense narrow media. In particular, narrow media sensor 345 is positioned, relative to bubble sensor 340, in such a location as to be employed as a narrow media indicator. If narrow media sensor 345 does not trip during the feeding of a media sheet, controller 101 can identify the media sheet being fed as narrow and make necessary adjustments to speed, temperature, and other operating parameters. For example, when a to-be-printed media sheet has a narrow media width, overheating problems may occur because the media sheet removes heat from the fuser only in the portion of the fuser contacting the media. As the portion of the fuser beyond the width of the media sheet does not lose any heat to the media sheet, such portion of the fuser becomes hotter than the portion contacting the media sheet and can be damaged due to high temperature. Since excessive thermal energy accumulated at the portion of the fuser not contacting the media (or "non-media portion") during narrow media printing can cause damage to the fuser, it is desirable to control the amount of thermal energy accumulated at the non-media portion to be below a certain level so that the fuser will not be damaged. To control the thermal energy accumulated at the non-media portion of the fuser, controller 101 utilizes the digital output of narrow media sensor 345 to determine whether or not the media sheet has a narrow width. In one example, when it is determined that the media sheet has a narrow width, media process speed and/or fusing speed may be reduced, and/or the interpage gap may be increased to limit the overheating of the non-media portion.

Figure 14:
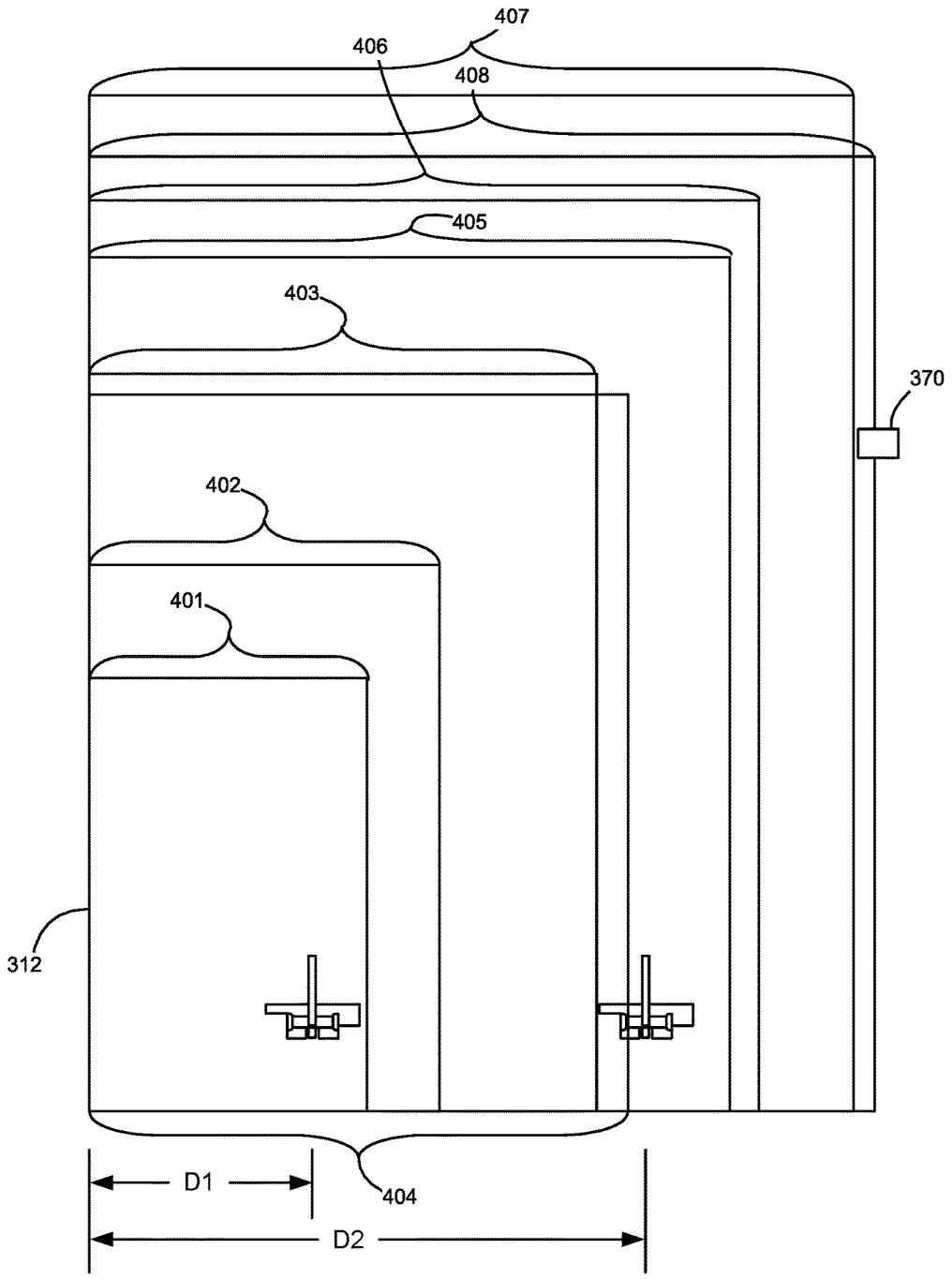
FIG. 14 illustrates positioning of the bubble sensor and the narrow media sensor relative to a plurality of media sheet sizes according to one example embodiment.

Media widths of standard media sizes typically vary from about 3 inches to about 8.25 inches. As an example, FIG. 14 illustrates eight media sizes 401, 402, 403, 404, 405, 406, 407 and 408, with media size 401 being the narrowest and then increasing in width through media sizes 402 to 408. Media sizes 401-408 may correspond to standard media sheet sizes such as 3×5 media, A6, Statement, A5, B5, Executive, A4 and Letter, respectively. It should be understood, however, that imaging device 100 may support more standard or non-standard media sizes. In one example embodiment, bubble sensor 340 may be positioned at distance D1 that is between about 0.5 inches and about 2.5 inches from the reference edge 312 to achieve reliable bubble detection for the narrowest supported media. Considering the example shown in FIG. 13, bubble sensor 340 is positioned between about 2 inches to about 2.5 inches from the reference edge 312 to allow reliable bubble detection for media 401. In general, the location of narrow media sensor 345 is optimized based on the location of bubble sensor 340 so as to achieve balanced load on the media sheet being fed and allow good entry of the media sheet into the fuser nip 325 to avoid print defects. In FIG. 13, narrow media sensor 345 is positioned before the non-reference edge (i.e., the side edge of the media sheet opposite the side edge that rides along the reference edge 312) of media 407 to optimize the balancing of load for the different supported media sizes. For example, narrow media sensor 345 is located at a position that would allow for a substantially flat media entry into the fuser nip 325 by A4 media and Letter media. A thermistor 370 may be disposed on fuser 114 at a location close to or beyond the non-reference edge of media 407 to measure heater and/or backup roll temperature at an end portion of fuser 114 opposite reference edge 312. Based on temperature feedback from to thermistor 370, controller 101 may control the speed of the media sheet to slow down or increase the inter-page gap to prevent overheating of fuser 114.

The heater temperature profile within the non-media portion during fusing is generally parabolic such that the hottest region is in the middle of the non-media portion. As media width gets narrower, the non-media portion becomes wider and the hottest region is shifted towards the reference edge 312 resulting in the hottest region of the non-media portion being shifted away from the location of thermistor 370, and thermistor 370 providing significantly lower temperature readings relative to the hottest region of the non-media portion. In this case, the significantly lower temperature feedback from thermistor 370 may not properly indicate that the non-media portion is overheating and/or that the sheet of media passing through the fuser nip is narrow media, and controller 101 may not be able to correctly adjust the speed of the media sheet to prevent overheating of fuser 114. In the example shown, the two narrowest supported media are media 401 and media 402. In order to prevent possible overheating damage due to media 401 and media 402, narrow media sensor 345 is positioned beyond the non-reference edge of media 402 and inside the non-reference edge of media 407. In this way, narrow media sensor 345 can detect narrow media which would allow for controller 101 to slow down the speed of the media sheet or increase the interpage gap to avoid overheating of fuser 114 even when thermistor 370 is providing significantly lower temperature feedback relative the hottest region of the non-media portion when narrow media such as media 401 and media 402 are being fed. In one example embodiment, narrow media sensor 345 may be positioned at distance D2 that is between about 4.5 inches and about 7.75 inches from the reference edge 312. In the example shown in FIG. 13, narrow media sensor 345 is positioned close to or beyond the non-reference edge of media 404. In this position, narrow media sensor 345 can detect media sheets that are narrower than media 405, such as media 401, 402, 403 and 404, allowing controller 101 to adjust the media sheet speed to avoid excessive overheating and fuser damage when feeding narrow media. When fusing the relatively wider media 405, 406, 407 or 408, the non-media portion of the fuser becomes narrower such that the hottest region of the non-media portion is located closer relative to the location of thermistor 370. As a result, thermistor 370 may provide temperature feedback that is not significantly lower than the hottest temperature region of the non-media portion, as compared to the case when narrow media is fed. Controller 101 may utilize the temperature feedback from thermistor 370 to control the speed of the media sheet to adjust the inter-page gap and prevent overheating in the fuser portion beyond the non-reference edge of the wide media sheet being fed.

The flag assembly of narrow media sensor 345 has been described above as providing both media size detection and load balancing on a media sheet. In other alternative example embodiments, the flag assembly of sensor 345 may be provided without the media size detection functionality. For example, the flag assembly of sensor 345 may be used in tandem with bubble sensor 340 to detect bubble formation, or sensor 345 may be provided as an inactive sensor such that the flag assembly of sensor 345 provides load balancing on the media sheet without sensing capability.

In the above example embodiments, the concepts of bubble control and narrow media identification using bubble sensor 340 and narrow media sensor 345 while providing more balanced load on the media sheet being fed are illustrated as occurring in media path assembly 300 between transfer roll pair 320 and roll-belt pair 330. However, it should be understood that the concepts provided herein may be performed between two feed nips or any two sets of independently driven media feed roll pairs located along the media path where there is sufficient space between the two sets of media feed roll pairs to allow bubble formation to occur in the media sheet. Further, the description of the details of the example embodiments have been described in the context of electrophotographic image devices. However, it will be appreciated that the teachings and concepts provided herein may be applicable to other imaging systems.

The foregoing description of embodiments has been presented for purposes of illustration. It is not intended to be exhaustive or to limit the present disclosure to the precise steps and/or forms disclosed, and obviously many modifications and variations are possible in light of the above teaching. It is intended that the scope of the invention be defined by the claims appended hereto.

What is claimed is:

1. A media path assembly in an imaging device, comprising:

a media guide positioned adjacent and transverse to a media path between a first nip and a second nip of the imaging device, the media guide directing a leading edge of a media sheet exiting the first nip into the second nip in a media process direction, the media guide having a curved surface forming a bubble chamber across the media path; and, a first flag assembly and a second flag assembly positioned adjacent to the media guide and the bubble chamber, the first and second flag assemblies positioned transverse to the media path and aligned with each other, a position of the second flag assembly corresponding to a location in the media guide at which a media sheet of a first media size contacts the second flag assembly when the media sheet of the first media size passes through the media path and at which the second flag assembly is not contacted by a media sheet of a second media size that is less than the first media size when the media sheet of the second media size passes through the media path, a position of the first flag assembly corresponding to a location in the media guide at which the media sheet of the first media size and the media sheet of the second media size contact the first flag assembly when passing through the media path, wherein the first flag assembly comprises a bubble sensor that is operative to indicate formation in the bubble chamber of a bubble in the media sheet exiting the first nip and, when the media sheet exiting the first nip is of the first media size, the second flag assembly applies a balancing force thereto relative to a force applied by the first flag assembly to the media sheet exiting the first nip so that the leading edge thereof when entering the second nip is substantially aligned with the second nip.

2. The media path assembly of claim 1, wherein the first nip is a toner transfer nip and the second nip is a fuser nip.

3. The media path assembly of claim 1, further comprising a reference edge positioned along a side of the media path along which a side edge of the media sheet exiting the first nip rides, wherein the first flag assembly is positioned at a first distance from the reference edge and the second flag assembly is positioned at a second distance greater than the first distance from the reference edge.

4. The media path assembly of claim 3, wherein the first flag assembly is positioned between about 0.5 inches and about 2.5 inches from the reference edge.

5. The media path assembly of claim 3, wherein the second flag assembly is positioned between about 4.5 inches to about 7.75 inches from the reference edge.

6. The media path assembly of claim 1, wherein the first flag assembly includes a pivotable flag arm projecting into the media path, wherein as a depth of the bubble in the media sheet exiting the first nip changes the flag arm changes position causing a change in an output of the bubble sensor.

7. The media path assembly of claim 6, wherein the output of the bubble sensor is an analog signal representative of the depth of the bubble.

8. The media path assembly of claim 6, wherein the output of the bubble sensor is used to adjust a sheet feeding speed at the second nip so as to maintain the bubble depth in the media sheet exiting the first nip within a predetermined range.

9. The media path assembly of claim 6, wherein the output of the bubble sensor is used to adjust a sheet feeding speed at the second nip to adjust the depth of the bubble to a predetermined bubble depth.

10. The media path assembly of claim 9, wherein the predetermined bubble depth is based on a media type of the media sheet exiting the first nip.

11. The media path assembly of claim 1, wherein each of the first and second flag assemblies includes a spring-biased flag arm projecting through a corresponding opening in the media guide and positioned in the bubble chamber.

12. The media path assembly of claim 11, wherein the spring-biased flag arm of the first flag assembly is substantially identical to the spring-biased flag arm of the second flag assembly.

13. The media path assembly of claim 1, wherein the second flag assembly corresponds to a media size sensor that is operative to indicate whether the media sheet exiting the first nip has a media size corresponding to one of the first media size and the second media size.

14. In an imaging device having a transfer roll and a backup roll forming a toner transfer nip therebetween, a fuser having a fusing nip positioned downstream of the toner transfer nip in a media process direction, a media guide positioned adjacent and traverse to a media path between the toner transfer nip and the fusing nip for directing a leading edge of a media sheet exiting the toner transfer nip into the fusing nip, the media guide having a bubble chamber adjacent the media path, a first media sensor and a second media sensor positioned adjacent to the media guide transverse to the media path and aligned with each other, a position of the second media sensor corresponding to a location in the media guide at which a media sheet of a first media size contacts the second media sensor when the media sheet of the first media size passes between the toner transfer nip and fusing nip and at which the second media sensor is not contacted by a media sheet of a second media size that is less than the first media size when the media sheet of the second media size passes between the toner transfer nip and the fusing nip, and a controller operatively coupled with the fuser, the first media sensor, and the second media sensor, a method for controlling bubble formation in the media sheet exiting the toner transfer nip in the media process direction, the method comprising:

advancing the media sheet exiting the toner transfer nip along the media path from the toner transfer nip to the fusing nip at a media process speed;

during the advancing of the media sheet exiting the toner transfer nip, determining whether the media sheet exiting the toner transfer nip has a media size corresponding to one of the first media size and the second media size based on a detection of a change in an output of the second media sensor as the media sheet exiting the toner transfer nip moves along the media guide;

controlling the fuser to operate at a first speed when the media size determined is the first media size, and at a second speed slower than the first speed when the media size determined is the second media size, the first and second speeds being slower than the media process speed at the toner transfer nip to allow for formation of a bubble in the media sheet exiting the toner transfer nip as the media sheet simultaneously traverses the toner transfer nip and the fusing nip;

determining a depth of the bubble in the media sheet exiting the toner transfer nip based on an output of the first media sensor; and, when the determined depth of the bubble in the media sheet exiting the toner transfer nip exceeds a first predetermined bubble depth, controlling the fuser to operate at a third speed greater than at least one of the first and second speeds to reduce the depth of the bubble towards a second predetermined bubble depth that is less than the first predetermined bubble depth.

15. The method of claim 14, wherein when the change in the output of the second media sensor is detected, determining that the media size of the media sheet exiting the toner transfer nip corresponds to the first media size.

16. The method of claim 14, wherein when the change in the output of the second media sensor is not detected, determining that the media size of the media sheet exiting the toner transfer nip corresponds to the second media size.

17. The method of claim 14, wherein when the depth of the bubble reaches the second predetermined bubble depth, controlling the fuser to return operation at the first speed when the media size corresponds to the first media size, and at the second speed when the media size corresponds to the second media size.

18. The method of claim 14, wherein the determining the depth of the bubble and the controlling the fuser to operate at the third speed when the determined depth of the bubble exceeds the first predetermined bubble depth are repeated until the media sheet exiting the toner transfer nip is no longer simultaneously traversing the toner transfer nip and the fusing nip.

19. The imaging apparatus of claim 18, further comprising a controller operatively coupled with the fuser, the first media sensor, and the second media sensor, wherein the controller is operative to control the fuser to operate at a first speed and a second speed slower than the first speed when the media size of the media sheet exiting the toner transfer nip corresponds to the first media size and the second media size, respectively, and at third speed greater than at least one of the first and second speeds when the depth of the bubble in the media sheet exiting the toner transfer nip, as detected by the first media sensor, exceeds a first predetermined bubble depth in order to reduce the depth of the bubble towards a second predetermined bubble depth less than the first predetermined bubble depth.

20. An imaging apparatus, comprising:

a transfer roll and a backup roll forming a toner transfer nip therebetween;

a fuser having a fusing nip positioned downstream of the toner transfer nip in a media process direction;

a media guide positioned adjacent and transverse to a media path portion between the toner transfer nip and the fusing nip for directing a leading edge of a media sheet exiting the toner transfer nip into the fusing nip, the media guide having a curved surface forming a bubble chamber;

a reference edge positioned parallel to the media path portion; and, a first media sensor and a second media sensor positioned adjacent the media guide transverse to the media path portion and aligned with each other, the first media sensor positioned adjacent the bubble chamber and transversely positioned at a first distance from the reference edge and the second media sensor transversely positioned at a second distance greater than the first distance from the reference edge such that a media sheet of a first media size contacts both the first and second media sensors when passing through the media path portion, and a media sheet of a second media size less than the first media size contacts the first media sensor and does not contact the second media sensor when passing through the media path portion, the first media sensor operative to indicate a depth of a bubble formed in the media sheet exiting the toner transfer nip and the second media sensor operative to indicate whether the media sheet exiting the toner transfer nip has a media size corresponding to one of the first media size and the second media size, wherein the second media sensor is positioned at the second distance such that when the media sheet exiting the toner transfer nip has the first media size, the second media sensor applies a balancing force thereto relative to a force applied by the first media sensor to the media sheet exiting the toner transfer nip so that the leading edge of the media sheet exiting the toner transfer nip when entering the fusing nip is substantially aligned with the fusing nip.

21. The imaging apparatus of claim 20, wherein the first media sensor is positioned between about 0.5 inches and about 2.5 inches from the reference edge.

22. The imaging apparatus of claim 20, wherein the second media sensor is positioned between about 4.5 inches to about 7.75 inches from the reference edge.

23. The imaging apparatus of claim 20, wherein each of the first and second media sensors includes a pivotable flag arm projecting into the media path portion.

24. The imaging apparatus of claim 23, wherein the flag arms of the first and second media sensors are substantially identical.

25. The imaging apparatus of claim 23, wherein each flag arm is independently pivotably mounted on the media guide and projecting through a corresponding opening in the media guide and into the media path portion.

* * * * *